US009505586B2

(12) United States Patent
Wu

(10) Patent No.: US 9,505,586 B2
(45) Date of Patent: Nov. 29, 2016

(54) ASSIGNED CAR INFORMATION DISPLAY APPARATUS FOR ELEVATORS

(75) Inventor: Wei Wu, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 568 days.

(21) Appl. No.: 14/007,782

(22) PCT Filed: Mar. 30, 2011

(86) PCT No.: PCT/JP2011/001897
§ 371 (c)(1),
(2), (4) Date: Nov. 12, 2013

(87) PCT Pub. No.: WO2012/131769
PCT Pub. Date: Oct. 4, 2012

(65) Prior Publication Data

US 2014/0054116 A1 Feb. 27, 2014

(51) Int. Cl.

| | |
|---|---|
| ***B66B 1/34*** | (2006.01) |
| ***B66B 5/00*** | (2006.01) |
| ***B66B 1/46*** | (2006.01) |
| ***B66B 3/00*** | (2006.01) |

(52) U.S. Cl.
CPC ..... *B66B 5/0012* (2013.01); *B66B 1/468* (2013.01); *B66B 3/006* (2013.01); *B66B 2201/4615* (2013.01); *B66B 2201/4676* (2013.01)

(58) Field of Classification Search
CPC ..... B66B 5/0012; B66B 1/468; B66B 3/006; B66B 2201/4615; B66B 2201/4676
USPC ..... 187/247, 380–388, 391, 393, 396
See application file for complete search history.

(56) References Cited

U.S. PATENT DOCUMENTS

| | | | | |
|---|---|---|---|---|
| 6,394,231 | B1 * | 5/2002 | Schuster | B66B 3/006 187/247 |
| 6,801,792 | B1 | 10/2004 | Schuster et al. | |
| 7,500,544 | B2 * | 3/2009 | Hakala | B66B 1/463 187/382 |
| 7,559,408 | B2 * | 7/2009 | Flynn | B66B 3/00 187/391 |

(Continued)

FOREIGN PATENT DOCUMENTS

| | | |
|---|---|---|
| EP | 1 803 675 A1 | 7/2007 |
| GB | 2 241 090 | 8/1991 |

(Continued)

OTHER PUBLICATIONS

Office Action issued on Jan. 7, 2015 in the corresponding Korean Patent Application No. 10-2013-7028376 (with English Translation).
Extended European Search Report issued Aug. 18, 2014 in Patent Application No. 11862794.2.
Office Action issued Feb. 25, 2014 in Japanese Patent Application No. 2013-506830 with English language translation.

(Continued)

*Primary Examiner* — Anthony Salata
(74) *Attorney, Agent, or Firm* — Oblon, McClelland, Maier & Neustadt, L.L.P.

(57) ABSTRACT

An assigned car information display apparatus for elevators is provided which is capable of providing a suitable display for a user by changing a representation method (such as a displayed graphic figure and color) of one and the same assigned car based on elevator user's attributes (such as a working department name, and personal preferences) even when the one and the same car is assigned to plural different destination floors. An assigned car information display device displays assigned car information for a specific user by changing, based on an attribute of a user, an attribute of the display screen when the assigned elevator car is displayed.

8 Claims, 8 Drawing Sheets

(56) References Cited

U.S. PATENT DOCUMENTS

| | | | | |
|---|---|---|---|---|
| 7,793,761 | B2 * | 9/2010 | Oberer | B66B 11/0233 187/391 |
| 8,061,485 | B2 * | 11/2011 | Finschi | B66B 1/468 187/384 |
| 8,136,636 | B2 * | 3/2012 | Bahjat | B66B 1/463 187/391 |
| 8,260,042 | B2 * | 9/2012 | Peng | B66B 5/0012 382/115 |
| 8,490,754 | B2 * | 7/2013 | Amano | B66B 1/2458 187/384 |
| 9,272,877 | B2 * | 3/2016 | Nakashima | B66B 1/468 |
| 2003/0051947 | A1 | 3/2003 | Friedli | |
| 2005/0167205 | A1 * | 8/2005 | Yamakawa | B66B 1/34 187/391 |
| 2009/0020372 | A1 | 1/2009 | Amano | |
| 2011/0127117 | A1 | 6/2011 | Amano | |
| 2012/0097486 | A1 * | 4/2012 | Suzuki | B66B 1/468 187/384 |
| 2012/0138389 | A1 | 6/2012 | Furutani | |
| 2012/0193173 | A1 * | 8/2012 | Wu | B66B 1/468 187/384 |
| 2013/0068568 | A1 * | 3/2013 | Nonami | B66B 1/468 187/381 |

FOREIGN PATENT DOCUMENTS

| | | | |
|---|---|---|---|
| JP | 1 162688 | | 6/1989 |
| JP | 1 226683 | | 9/1989 |
| JP | 4 286582 | | 10/1992 |
| JP | 6-69582 | A | 3/1994 |
| JP | 6 329344 | | 11/1994 |
| JP | 9-156845 | A | 6/1997 |
| JP | 2001 186096 | | 7/2001 |
| JP | 2006 48479 | | 2/2006 |
| KR | 10-2007-0085484 | | 8/2007 |
| KR | 10-2010-0135912 | | 12/2010 |
| WO | WO 2007/049328 | A1 | 5/2007 |
| WO | 2010 023723 | | 3/2010 |
| WO | WO 2011/027429 | A1 | 3/2011 |

OTHER PUBLICATIONS

International Search Report Issued May 31, 2011 in PCT/JP11/001897 Filed Mar. 30, 2011.

Combined Chinese Office Action and Search Report issued Dec. 18, 2014 in Patent Application No. 201180069651.0 (with English Translation and English Translation of Categories of Cited Documents).

* cited by examiner

ASSIGNED CAR INFORMATION DISPLAY APPARATUS FOR ELEVATORS

TECHNICAL FIELD

The present invention relates to display contents in an assigned car information display apparatus for elevators, installed at a security gate.

BACKGROUND ART

In an elevator group control system that controls plural elevator cars, assignment of an elevator car is to assign one of the plural elevator cars to a user according to a user's destination floor, in consideration of dynamic situations of the plural elevator cars.

In an elevator group control system that controls plural elevator cars as one group, a conventional apparatus for registering an elevator hall call includes elevator hall destination registering means, provided at an elevator hall, for designating a user's destination floor; and assigned elevator car display means for displaying an elevator car to which a destination floor is assigned when the destination floor is registered using this elevator hall call destination registering means (refer to Patent Document 1, for example).

Also, it is disclosed that when such an assignment is performed, algorithm for an elevator group control device is used to display a user's destination floor on a display unit installed in an elevator hall (refer to Patent Document 2, for example).

It is further disclosed that a user's destination floor is registered not only in an elevator hall, but also at a security gate in the entrance hall. When a building user passes through the gate, the user's destination floor information is entered into an elevator group control system and thereby an assigned elevator car to the user's destination floor is displayed on a display unit for assigned car information, installed at the gate (refer to Patent Document 3, for example).

RELATED ART LITERATURE

Patent Document

Patent Document 1 JP-A-H01-226683
Patent Document 2 GB2241090
Patent Document 3 Japanese Patent Application H06-69582

SUMMARY OF THE INVENTION

Problems that the Invention is to Solve

In the foregoing conventional technique, a content appearing on a display unit for assigned car information is limited to a content for displaying only the designation of an elevator car assigned to a user's destination floor, as disclosed in Patent Document 2. In some cases, there is possibility for such a conventional display way to bring a user(s) passing through a security gate into confusion and to reduce efficiency in passing through the gate.

In the conventional elevator system, as disclosed in Patent Document 2 , displaying a user's destination floor together with an assigned elevator car when the user passes through the gate leads to disclosure of the user's destination floor to different users, which disclosure is undesirable from a security's viewpoint. In contrast, the assigned elevator car alone can be displayed without displaying the user's destination floor; however, when plural users continually pass through the gate, a problem arises as will be described below.

In general, an operational flow is that when a user passes through the gate, user's destination floor information is first acquired through a device such as authentication means and next registered into an elevator group control system, to determine an elevator car to be assigned to the user's destination floor, and finally the elevator car determined is displayed to the user, using a display unit installed at the gate. In this case, the elevator car assigned is displayed only while the user is passing through the gate; thus, in general practice, the information is displayed for several seconds so that the user can recognize it.

When the plural users continually pass through the gate, however, an assigned elevator car for a user needs to be sequentially displayed one by one. For that reason, every time an assigned elevator car is newly determined, the display content needs to be renewed. And yet, even when the users' destination floors are different, one and the same car is in some cases assigned depending on dynamic situations of plural elevator cars. In other words, one and the same car is assigned to different users, and the assigned car information is displayed using the same content. In that case, the user cannot discern whether the information displayed is of the assigned elevator car for the user himself or herself, or whether it is of that for a user who has previously passed therethrough.

Further, due to recent internationalization, users of an elevator system in many cases speak plural different languages. Since the users pass through the gate one by one from a security viewpoint, appropriate information is required to appear in line with a user's own language; however, the system cannot generally be said to have good support for such displaying.

In addition, when any boarding car cannot be assigned under abnormal conditions of the elevator system, or when the elevator cannot be serviced in a situation such as maintenance, assigned car information cannot be displayed, resulting in confusion of the users passing through the gate, thus influencing the passing efficiency therethrough. Under such an abnormal condition, it is demanded that information of the elevator situation, and clear instructions on the use of elevator be provided visually and audibly in plural languages to unspecified large number of users; however, the system cannot generally be said to have good support for such displaying.

The present invention is directed to overcome the above problems, and an object of the invention is to provide an assigned car information display apparatus for elevators, that provides an appropriate display information in line with users' own languages, and that visibly and audibly provides, even under an abnormal condition, information of the elevator situation and clear instructions on the use of elevator in plural languages to unspecified large number of users.

Means for Solving the Problems

In order to overcome the above problems, in an elevator system configured with a security authentication device that performs a security authentication transaction performed when an elevator user passes through a gate such as a security gate in an entrance hall, located away from an elevator hall, of a building; a security-authentication-transaction-linked destination floor registering means that registers a destination floor of the elevator user, by being linked to the security authentication transaction; an elevator group control device that controls an entire elevator group constituted of a plurality of elevator cars so as to operate efficiently, in consideration of an operation status of the elevator group; and an assigned car information display device disposed at the security gate, the display device displaying information of an assigned elevator car when the user passes through the security gate, the assigned elevator car being one car assigned by the elevator group control device to a destination floor registered by the user, an assigned car information display apparatus for elevators, according to this invention is designed wherein the assigned car information display device changes, based on an attribute of the user, any one of a language, a font, a graphic figure and a color in a displayed message on a display screen when the assigned elevator car is displayed, and thereby displays assigned car information for a specific user.

Further, an assigned car information display apparatus for elevators, according to this invention is designed wherein the attribute of the display screen includes at least any one of a language, a font, a graphic figure and a color in a display message.

Still further, an assigned car information display apparatus for elevators, according to this invention is designed wherein the attribute of the user includes at least any one of a working department name, a language, and personal preferences for color and graphic figure.

Yet still further, an assigned car information display apparatus for elevators, according to this invention is designed wherein when, because of a communications failure between apparatus constituent elements and of a limited processing capability of the elevator group control device, no elevator car can be assigned to a user or no information of an assigned car can be displayed, the assigned car information with clear instructions on the use of elevator is displayed in plural languages to unspecified large number of users.

Further, an assigned car information display apparatus for elevators, according to this invention is designed wherein audio information is provided in addition to visual information.

Advantageous Effects of the Invention

According to this invention, in an elevator system configured with a security authentication device that performs a security authentication transaction performed when an elevator user passes through a gate such as a security gate in an entrance hall, located away from an elevator hall, of a building; a security-authentication-transaction-linked destination floor registering means that registers a destination floor of the elevator user, by being linked to the security authentication transaction; an elevator group control device that controls an entire elevator group constituted of a plurality of elevator cars so as to operate efficiently, in consideration of an operation status of the elevator group; and an assigned car information display device disposed at the security gate, the display device displaying information of an assigned elevator car when the user passes through the security gate, the assigned elevator car being one car assigned by the elevator group control device to a destination floor registered by the user, the assigned car information display device changes, based on an attribute of the user, an attribute on the display screen when an assigned elevator car is displayed, and then displays assigned car information to a specific user, thereby improving efficiency of passing through a security gate; in addition, this results in no disclosure of a destination floor of the user to other users, thus leading to enhanced security. Further, when one and the same car is assigned to different users, and the assigned car information is displayed using the same content, the user can discern whether the information displayed is of the assigned car for the user, or whether it is of that for a user who has previously passed, and an appropriate display action is possible in line with the user's own language. Under an abnormal condition, it is further possible that the assigned car information display apparatus for elevators visually and audibly provides information of the elevator situation, and clear instructions on the use of elevator, in plural languages to unspecified large number of users.

MODES FOR CARRYING OUT THE INVENTION

Example 1

Embodiment 1

An assigned car information display apparatus for elevators, according to Embodiment 1 of the present invention will be described below in detail with reference to the drawings.

Figure 1:
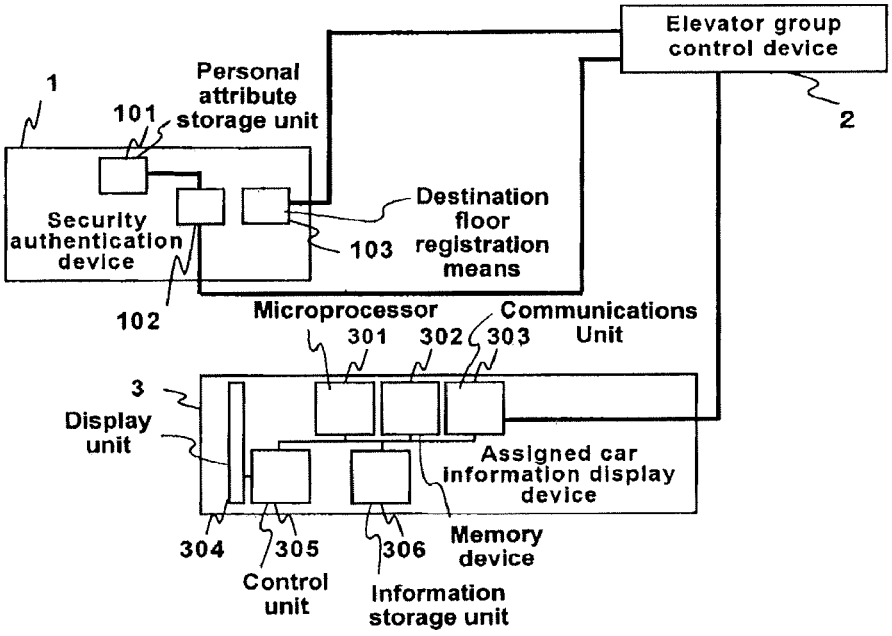
FIG. 1 is a block diagram showing an overall configuration of an assigned car information display apparatus for elevators, according to Embodiment 1 of the invention.

FIG. 1 shows a block diagram of an overall configuration according to Embodiment 1 of the present invention. In the figure, designated by reference numeral 1 is a security authentication device that performs security authentication of elevator users; by reference numeral 2, an elevator group control device that controls an entire elevator group so as to operate efficiently, in consideration of an operation status of the elevator group constituted of plural elevator cars; and by reference numeral 3, an assigned car information display device that displays information of an elevator car—assigned by the elevator group control device—for a destination floor registered by the user.

The security authentication device 1 includes a personal attribute storage unit 101 that stores user's attribute data (an ID, a working department name, a language, and personal preferences for color and graphic figure); personal attribute data transfer means 102 that transfers the already-stored user's attribute data to the group control device 2; and security-authentication-transaction-linked destination floor registering means 103 that registers a destination floor of the elevator user, synchronously with the authentication transaction.

Further, the assigned car information display device 3 includes a display unit 304 that displays the assigned car information; a display control unit 305 for controlling processes of the display control unit 304; a data storage unit 306 that stores content data for displaying the assigned car information, and a command-display content table for command items from the elevator group control device and their associated display contents; a communications unit 303 that communicates with an external device; a microprocessor 301 that performs processing transactions of these units; and a memory device 302.

Operation of the display apparatus for elevators will be described next.

The security authentication device 3 performs security authentication of the elevator users. And the security-authentication-transaction-linked destination floor registering means 103, which in advance registers in the group control device 2 a destination floor for each of the elevator users, is used to perform the authentication, and at the same time, to register the destination floor of the elevator user in the group control device 2. Further, transferred to the group control device 2 are the user's attribute data (the ID, the working department name, the language, and the personal preferences for color and graphic figure) in advance stored in the personal attribute storage unit 101 of the security authentication device.

A specific control operation of the elevator group control apparatus is that one elevator car out of plural elevator cars is assigned to a destination floor of an elevator user, registered from the security authentication device 1 and stored by the security-authentication-transaction-linked destination floor registering means 103 so that the entire elevator car group is effectively operated, and that an elevator car assigned and a method of displaying the assigned car information are further instructed, based on the user's attribute data received from the security authentication device 1, to the assigned car information display device 3.

In the assigned car information display device 3, the display unit 304 and the display control unit 305 display contents of the assigned car information received from the elevator group control device 2. Here, the display unit 304 may be of any suitable type, such as a liquid crystal display, plasma display, LED or Brown tube, that is capable of displaying characters and graphic figures.

The communications unit 303 communicates between the assigned car information display apparatus for elevators, 3 and the elevator group control device 2. Display command items (assigned car information, and a displaying method) for an assigned elevator car are acquired through the communications with the elevator group control device 2. Note that the communications unit 303 may use any suitable communications scheme that enables information transfer, in particular regardless of wired or wireless communications mode.

The display information storage unit 306 stores display content data per se for assigned car information, the table for the display command items and their corresponding display contents, and the like.

The microprocessor 301 controls the above processing of each unit.

The memory device 302 includes a program memory and a working memory.

Here, the program memory and the display information storage unit 306 may be any suitable memory device or memory element, such as hard disc drive, nonvolatile memory, or random access memory that requires memory refresh, or some portions of the storage unit may be configured as the same types of memory devices or elements, or alternatively the memory device 302 and the display information storage unit 306, including the various control units and the communications unit, may be built in to the microprocessor. A detachable nonvolatile storage is used for the display information storage 306 when the communications unit 303 is not provided.

Figure 3:
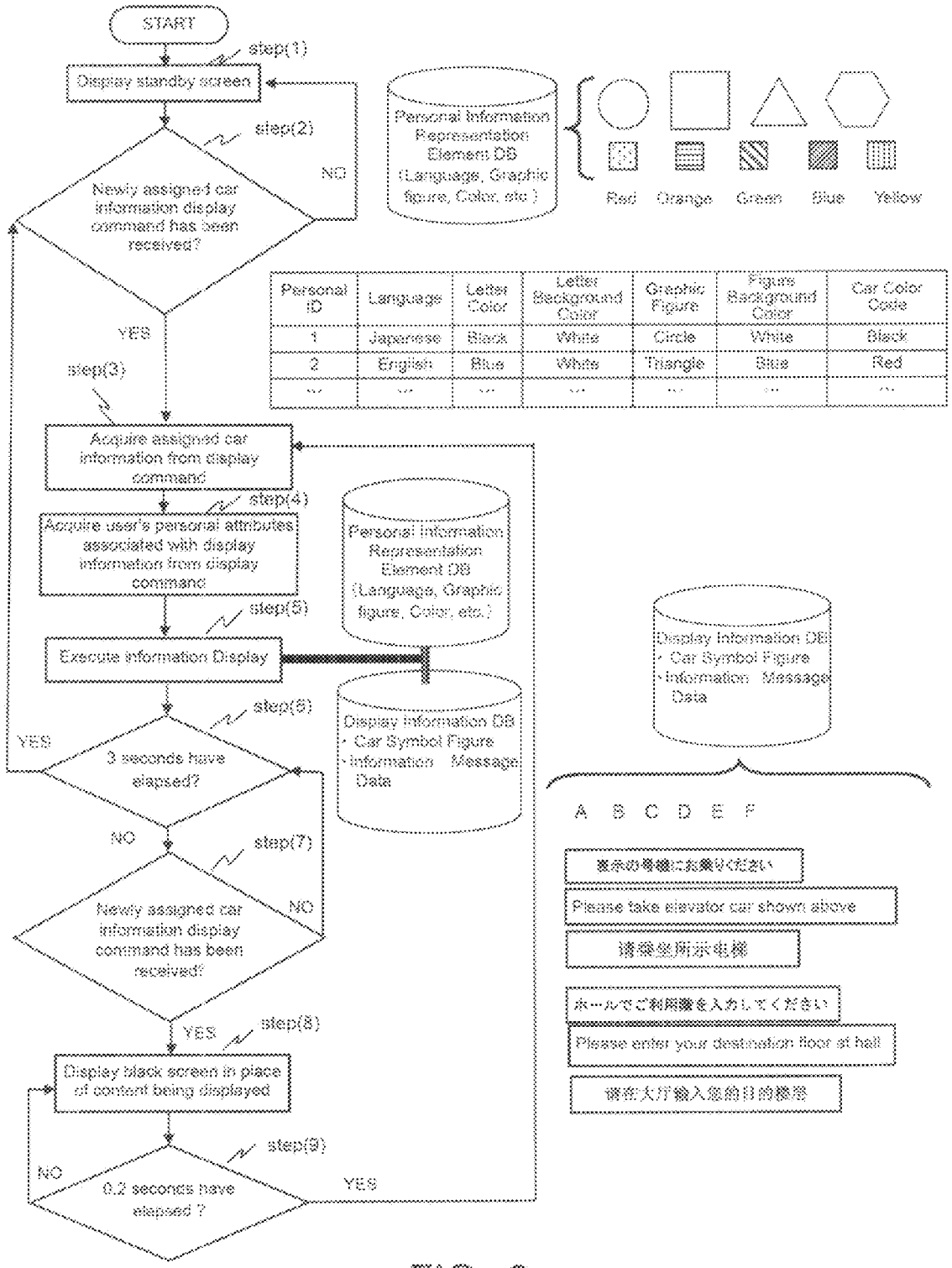
FIG. 3 is a flow diagram of the assigned car information display apparatus for elevators, according to Embodiment 1 of the invention.

FIG. 3 shows a flow diagram illustrating process operations in the devices and units of the present apparatus according to Embodiment 2 of the present invention, in terms of the apparatus configuration of FIG. 1.

Figure 4:
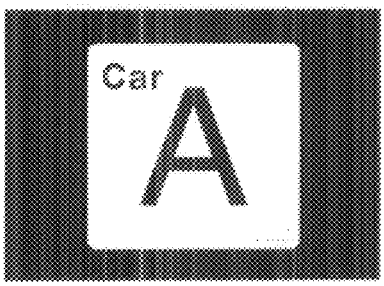
FIG. 4 is a display example of the assigned car information display apparatus for elevators, according to Embodiment 1 of the invention.
Figure 5:
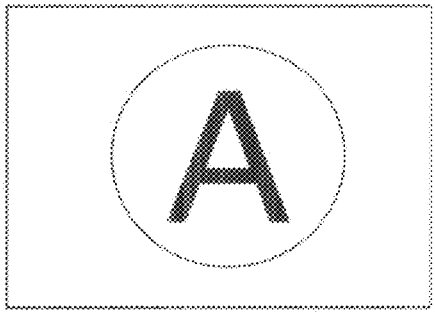
FIG. 5 is another display example of the assigned car information display apparatus for elevators, according to Embodiment 1 of the invention.
Figure 6:
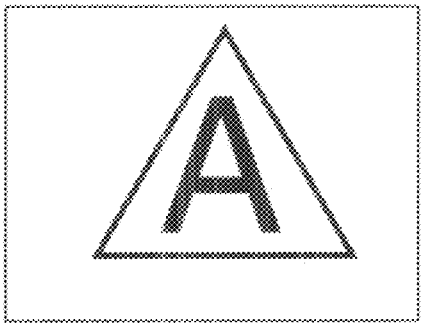
FIG. 6 is still another display example of the assigned car information display apparatus for elevators, according to Embodiment 1 of the invention.
Figure 7:
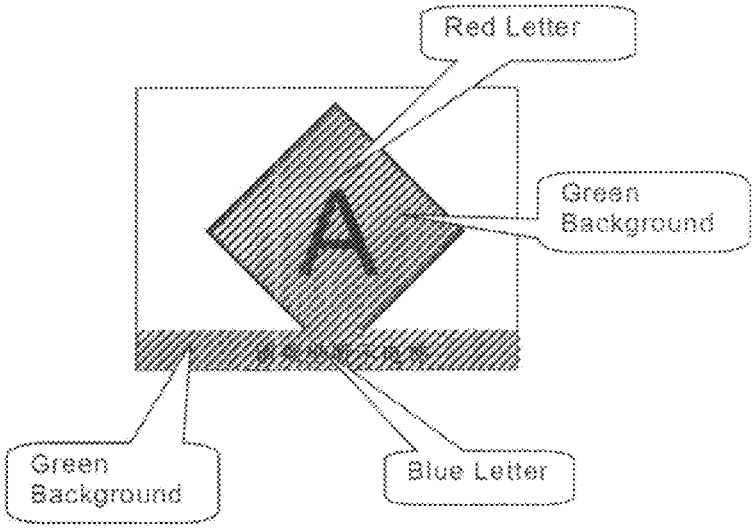
FIG. 7 is yet another display example of the assigned car information display apparatus for elevators, according to Embodiment 1 of the invention.
Figure 8:
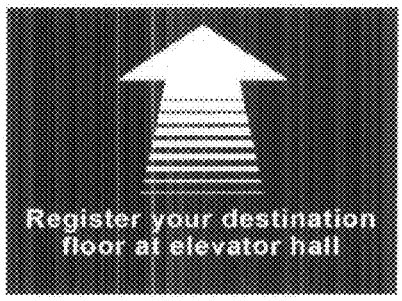
FIG. 8 is still yet another display example of the assigned car information display apparatus for elevators, according to Embodiment 1 of the invention.
Figure 9:
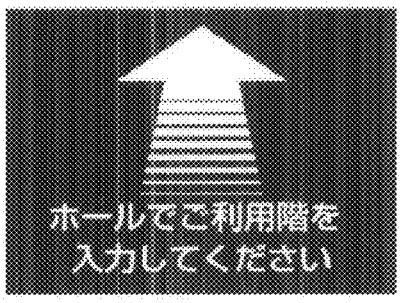
FIG. 9 is another display example of the assigned car information display apparatus for elevators, according to Embodiment 1 of the invention.

The flow diagram will be described below with reference to FIG. 4.

A standby screen, such as a display background, is displayed as needed. The standby screen appears when no display command for assigned elevator car information is present.

Through communications with the elevator group control device 2, it is checked whether or not a display command for newly assigned car information has been received from the elevator group control device 2. When no display command for the newly assigned car information has been received, the process returns to step (1), while when the display command therefor has been received, the process proceeds to step (3). Here, a display command for assigned car information refers to a command for displaying an assigned elevator car. Accordingly, assigned car information (for example, car A or car B) is first acquired from the display command, and the process proceeds to step (4).

In the apparatus configuration in FIG. 1, the display command also contains the user's personal attributes associated with display information (the personal ID, the working department name, the language, the personal preferences for color and graphic figure, and the like); thus, individual user's attributes associated with display information are acquired at this time, and the process proceeds to step (5).

Base on command data (elevator car and its representation method) for the information representation acquired in step (3) and step (4), necessary information is searched for in two databases, "personal information representation element DB" and "car information DB," and display information instructed is created and displayed, and then the process proceeds to step (6).

A determination is made whether three seconds has elapsed after the assigned car information has been displayed. If three seconds has elapsed, then the process returns to step (2), while if three seconds has not elapsed, then the process proceeds to step (7).

Again through communications with the elevator group control device 2, it is checked whether or not a display command for newly assigned car information has been received from the elevator group control device 2. If no display command for the newly assigned car information is present, then the process returns to step (6), while if the display command thereof is present, then the process proceed to step (8).

In order to cause the user to clearly recognize that the newly assigned car information is being displayed, the assigned car information, currently being displayed, is once canceled and a black screen is caused to appear instead, and the process proceeds to step (9).

A determination is made whether 0.2 seconds have elapsed after the black screen has appeared. If 0.2 seconds have elapsed, then the process returns to step (3), while if 0.2 seconds have not elapsed, then the process returns to step (8).

In this connection, the display time periods (a period of three seconds for displaying assigned car information, and a period of 0.2 seconds for the black screen to provide a break time) referred to in the above embodiments represent only one example, and it does not matter if display time periods other than those are employed. Further, although an example is described above in which when a newly assigned car information display command is received while the existing assigned car information is being displayed, the black screen is caused to appear for a short time in order to clearly notify an elevator user that newly assigned car information is provided for the user, the invention does not need to be limited to the black screen, and it does not matter if no black screen is displayed, or alternatively, another time break screen which is non-black color screen may be used, so long as the fact that the newly assigned car information is being displayed can clearly be notified to the user.

Embodiment 2

Figure 2:
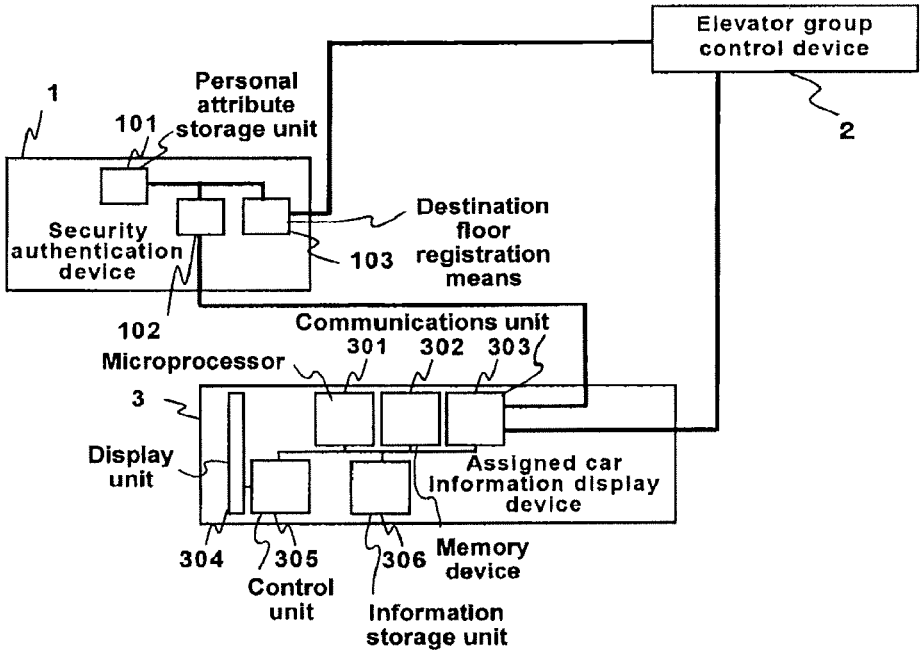
FIG. 2 is a block diagram showing an overall configuration of an assigned car information display apparatus for elevators, according to Embodiment 2 of the invention.

FIG. 2 shows a block diagram of an overall configuration according to Embodiment 2 of the present invention. Only difference in configuration from FIG. 1 will be described herein. User identifiable data (such as a personal ID) alone, contained in the user attribute data that has already been recorded in the security authentication device, is transferred, together with information of the destination floor, to the elevator group control device 2. In addition, the user attributes (a personal ID, a working department name, a language, personal preferences for color and graphic figure, and the like) associated with information to be displayed are transferred directly to the assigned car information display device 3, not to the group control device 2.

The elevator group control device 2 instructs the assigned car display device 3 to display an elevator car assigned. The display instruction contains user identifiable data (such as the personal ID) and information of the assigned elevator car. The communications unit 304 in the assigned car information display device 3 communicates between the assigned car display device 3 and the elevator group control device 2, and further between the display device 3 and the security authentication device 1. The user identifiable data and the display command for the elevator car assigned to the user are acquired through communications with the elevator group control device 2. Further, acquired through communications with the security authentication device 1 are the user attributes associated with display information for the user the personal ID, the working department name, the language, and the personal preferences for color and graphic figure.

Figure 10:
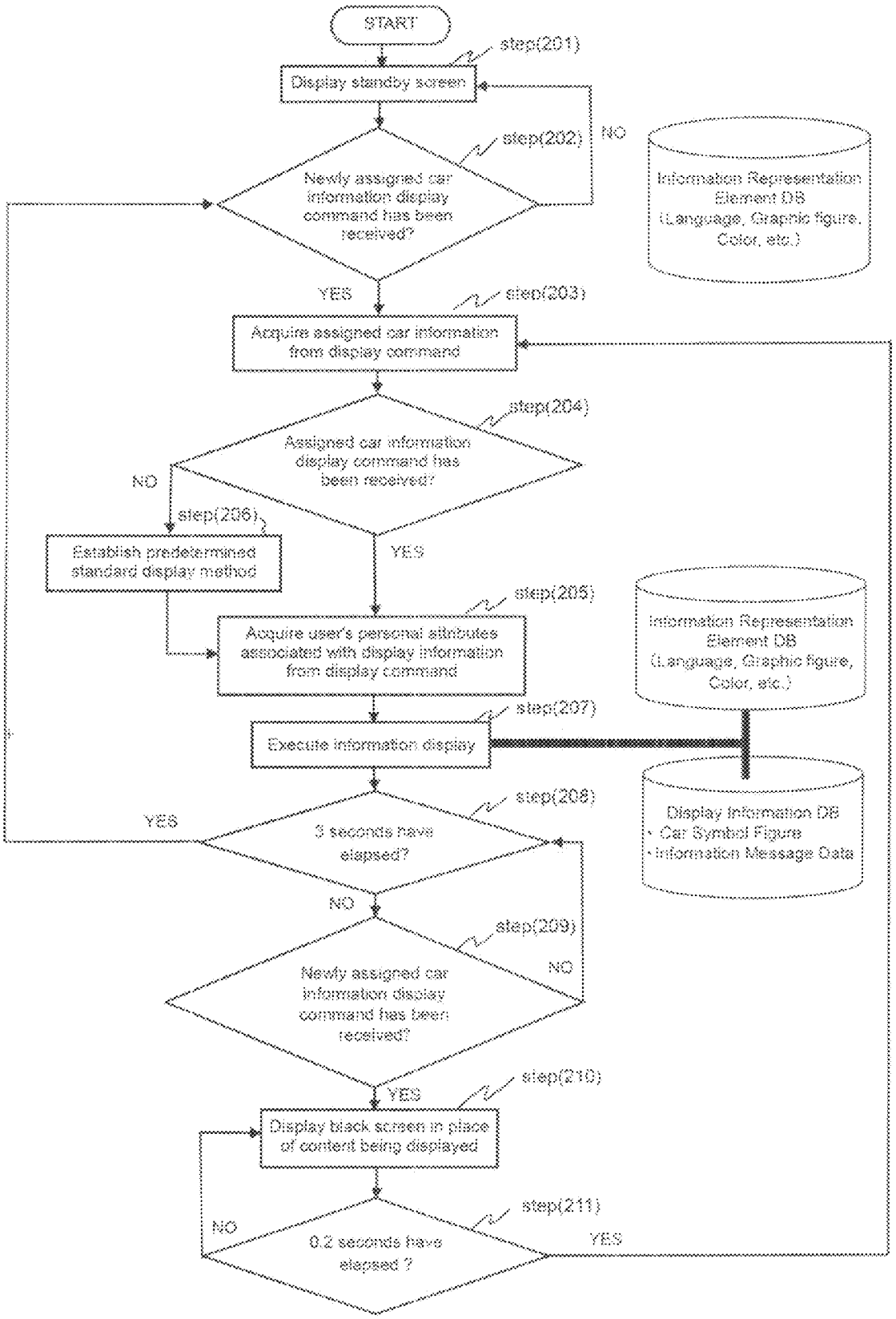
FIG. 10 is a flow diagram of the assigned car information display apparatus for elevators, according to Embodiment 2 of the invention.

FIG. 10 shows a flow diagram illustrating process operations in various devices and units of the present apparatus according to Embodiment 2 of the present invention, in terms of the apparatus configuration of FIG. 2.

The flow diagram will be described below with reference to FIG. 10; however, only difference from the process flows of FIG. 3 will be described.

Step (1) through step (2) are the same as those in FIG. 3.

Here, a display command for assigned car information refers to a command for displaying an elevator car assigned. Accordingly, assigned car information (for example, car A or car B) is first acquired from the display command, and the process proceeds to step (4). Further, since in the apparatus configuration of FIG. 2 the display command for the assigned car information contains individually identifiable user's attributes (such as a personal ID), the individually identifiable user's attributes are acquired as well, and the process proceeds to step (4).

In the apparatus configuration of FIG. 2, through communications with the security authentication device, it is checked whether or not the display command associated with the method of displaying the information (the personal ID, the working department name, the language, the personal preferences for color and graphic figure, and the like) has been received.

If the display command associated with the method of displaying the information has been received, then the process proceeds to step (5). Unless the display command associated with the method of displaying the information has been received, then a predetermined standard representation method (such as a representation language, graphic figure, color, etc.) is established, and the process proceeds to step (6).

The display command associated with the method of displaying the information contains the user's personal attributes (the personal ID, the working department name, the language, the personal preferences for color and graphic figure, and the like). Here, based on the user identifiable attributes acquired in step (3), an attribute associated with information display for the user is acquired, and the process proceeds to step (6).

Step (208) through step (211) have the same processing flows as in FIG. 3.

Embodiment 3

Figure 11:
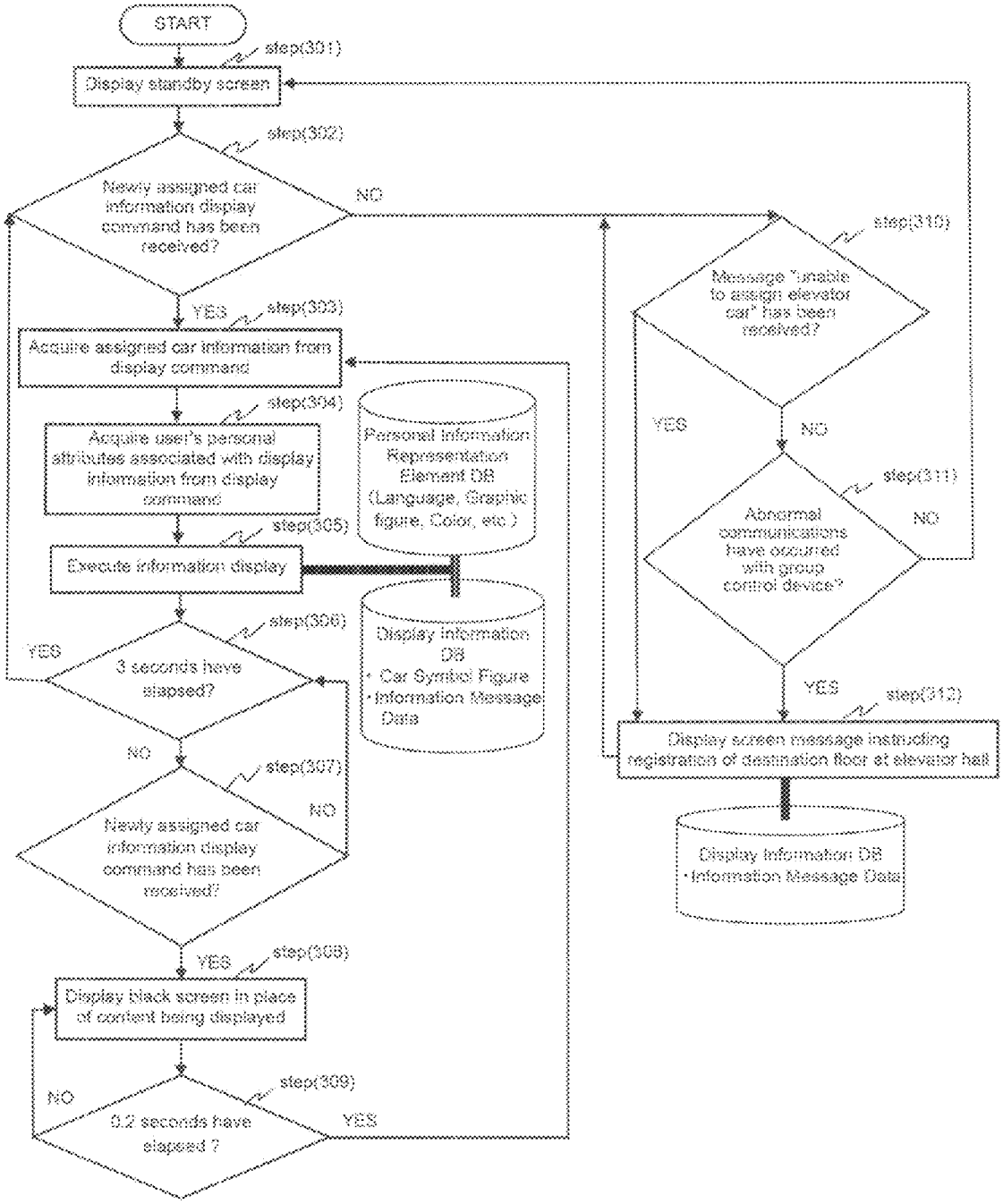
FIG. 11 is a flow diagram of an assigned car information display apparatus for elevators, according to Embodiment 3 of the invention.
Figure 12:
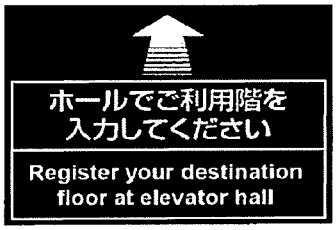
FIG. 12 is a display example of the assigned car information display apparatus for elevators, according to Embodiment 3 of the invention.

FIG. 11 shows a flow diagram illustrating processing operations in various devices and units in the present apparatus according to Embodiment 3 of the present invention; however, the processes in step (1) and step (3) through step (7) in the process flow diagram in FIG. 3 or those in corresponding steps FIG. 10, are similar to those in corresponding steps in FIG. 11 as well. Thus, their descriptions are not provided herein, and different processes will be described below.

In step (2), through communications with the elevator group control device 2, it is checked whether or not the display command for newly assigned car information has been received from the elevator group control device 2. A display command is a command for displaying an assigned elevator car. Unless the display command for newly assigned car information has been received, then the process proceeds to step (8), while if the display command therefor has been received, then the process proceeds to step (3).

Due to abnormal communications between the security authentication device and the group control apparatus or to the processing load or the like of the group control apparatus, the assignment of an elevator car cannot be made in some cases. In that case, the elevator group control apparatus sends a message "unable to assign elevator car" to the assigned car information display device. Through communications with the elevator group control apparatus, it is checked whether or not the message "unable to assign elevator car" has been received from the elevator group control apparatus, and if such a message is present, then the process proceeds to step (10), while unless such a message is present, then the process proceeds to step (9).

Likewise, the assignment of an elevator car cannot be made because of abnormal communications between the assigned car information display device and the group control apparatus. If the assigned car information display device determines that the abnormal communications have occurred with the group control apparatus, then the process proceeds to step (10), while unless the abnormal communications therewith are present, the process again returns to step (2).

Due to the inability to display the assigned elevator car, in order not to cause the elevator users to stay in the neighborhood of the security authentication device, the process again returns to step (8) with an attention message "please register your destination floor at elevator hall" being displayed in plural languages to unspecified large number of users.

Embodiment 4

Figure 13:
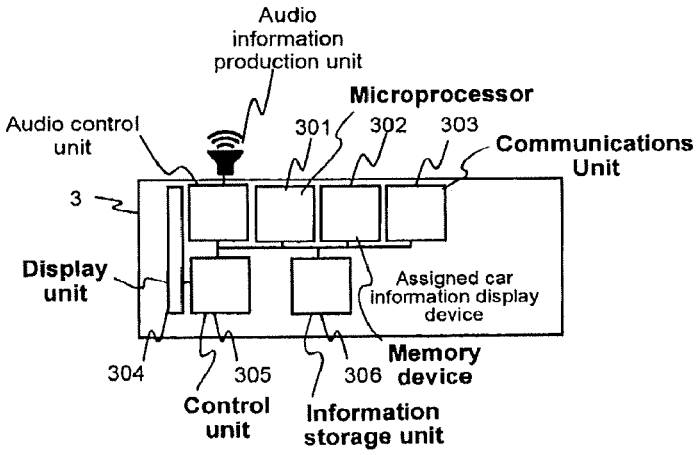
FIG. 13 is a block diagram showing an overall configuration of an assigned car information display apparatus for elevators, according to Embodiment 4 of the invention.

FIG. 13 shows an example of a device configuration according to Embodiment 4 of the present invention. In this embodiment, in order to enhance an advantageous effect, the assigned car information display device is configured with an additional audio information unit (audio control unit and audio information production unit). When the authentication is performed, the audio information unit, having the audio control unit and the audio information production unit, provides information of an assigned elevator car using a voice message according to elevator user's attribute data (language and the like). In this embodiment, the audio information unit is part of units within the assigned car information display device; however, it is conceivable that if the unit can only receive the content of audio information through communications with the elevator group control apparatus or the assigned car information display apparatus, the audio information unit is disposed independently.

REFERENCE NUMERALS

1 Elevator group-control device
2 Security authentication device
201 Personal attribute storage unit
202 Personal attribute data transferring means
203 Security-authentication-transaction-linked destination floor registering means
3 Assigned car information display device
301 Microprocessor
302 Memory device
303 Communications unit
304 Display unit
305 Display control unit 306 Display information storage unit

The invention claimed is:

1. An assigned car information display apparatus for elevators, in an elevator system configured with a security authentication device that performs a security authentication transaction performed when an elevator user passes through a gate such as a security gate in an entrance hall, located away from an elevator hall, of a building;

a security-authentication-transaction-linked destination floor registering means that registers a destination floor of the elevator user, by being linked to the security authentication transaction;

an elevator group control device that controls an entire elevator group constituted of a plurality of elevator cars so as to operate efficiently, in consideration of an operation status of the elevator group; and an assigned car information display disposed at the security gate, the display displaying information of an assigned elevator car when the user passes through the security gate, the assigned elevator car being one car assigned by the elevator group control device to a destination floor registered by the user, wherein the assigned car information display changes, based on a previously stored attribute of the user, any one of a language, a font, a graphic figure or a color in a displayed message on a display screen when the assigned elevator car is displayed, and thereby displays assigned car information for a specific user, wherein if there is no display command for a newly assigned car from the elevator group control device, the assigned car information display device displays the assigned car information currently being displayed for a predetermined period, and wherein if there is a new display command for newly assigned car from the elevator group control device, the assigned car information display device cancels displaying of the assigned car information currently being displayed, displays a break screen notifying that the newly assigned car information will be displayed, and then displays the newly assigned car information.

2. The assigned car information display apparatus for elevators of claim 1, wherein the attribute of the user includes at least any one of a working department name, a language, and personal preferences for color and graphic figure.

3. The assigned car information display apparatus for elevators of claim 1, wherein when, because of a communications failure between apparatus constituent elements and of a limited processing capability of the elevator group control device, no elevator car can be assigned to a user or no information of an assigned car can be displayed, notice facilitating a user's action is displayed in plural languages to an unspecified large number of users without displaying the assigned car information.

4. The assigned car information display apparatus for elevators of claim 1, wherein the display apparatus provides audio information in addition to the visual information.

5. The assigned car information display apparatus for elevators of claim 2, wherein the display apparatus provides audio information in addition to the visual information.

6. The assigned car information display apparatus for elevators of claim 3, wherein the display apparatus provides audio information in addition to the visual information.

7. An assigned car information display apparatus for elevators, in an elevator system configured with:

a security authentication device that performs a security authentication transaction performed when an elevator user passes through a gate such as a security gate in an entrance hall, located away from an elevator hall, of a building;

a security-authentication-transaction-linked destination floor registering means that registers a destination floor of the elevator user, by being linked to the security authentication transaction;

an elevator group control device that controls an entire elevator group constituted of a plurality of elevator cars so as to operate efficiently, in consideration of an operation status of the elevator group; and an assigned car information display disposed at the security gate, the display displaying information of an assigned elevator car when the user passes through the security gate, the assigned elevator car being one car assigned by the elevator group control device to a destination floor registered by the user, wherein the assigned car information display changes, based on an attribute of the user, display form including anyone of a language, a font, a graphic figure or a color without changing a content of the information of the assigned elevator car when the assigned elevator car is displayed, and thereby displays the content of the information of the assigned elevator car in the changed display form.

8. The assigned car information display apparatus for elevators of claim 7, wherein if there is no display command for newly assigned car from the elevator group control device, the assigned car information display displays the assigned car information currently being displayed for a predetermined period, and wherein if there is a new display command for newly assigned car from the elevator group control device, the assigned car information display cancels displaying of the assigned car information currently being displayed, displays a break screen notifying that the newly assigned car information will be displayed, and then displays the newly assigned car information.

* * * * *